US006525462B1

(12) United States Patent
Kim

(10) Patent No.: US 6,525,462 B1
(45) Date of Patent: Feb. 25, 2003

(54) CONDUCTIVE SPACER FOR FIELD EMISSION DISPLAYS AND METHOD

(75) Inventor: Won-Joo Kim, Boise, ID (US)

(73) Assignee: Micron Technology, Inc., Boise, ID (US)

( * ) Notice: Subject to any disclaimer, the term of this patent is extended or adjusted under 35 U.S.C. 154(b) by 0 days.

(21) Appl. No.: 09/275,522

(22) Filed: Mar. 24, 1999

(51) Int. Cl.[7] ..... H01J 1/90; H01J 19/44

(52) U.S. Cl. ..... 313/496; 313/292; 313/497; 313/243

(58) Field of Search ..... 313/495, 497, 313/422, 238, 243, 250, 252–53, 257–58, 283–84, 292; 445/25–26

(56) References Cited

U.S. PATENT DOCUMENTS

| | | | | |
|---|---|---|---|---|
| 3,397,278 A | | 8/1968 | Pomerantz | 174/52 |
| 5,232,549 A | | 8/1993 | Cathey et al. | 456/633 |
| 5,717,287 A | | 2/1998 | Amrine et al. | 313/495 |
| 5,770,918 A | * | 6/1998 | Kawate et al. | 313/495 |
| 5,980,349 A | * | 11/1999 | Hofmann et al. | 445/26 |
| 5,990,614 A | * | 11/1999 | Spindt | 313/422 |
| 6,249,083 B1 | * | 6/2001 | Kim | 313/495 |
| 6,278,233 B1 | * | 8/2001 | Sanou et al. | 313/495 |

OTHER PUBLICATIONS

Wallis, G. and Pomerantz, D. I., "Field Assisted Glass–Metal Sealing", Journal of Applied Physics, Vol. 40, No. 10, Sep. 1969, pp. 5946–5949.

W. Y. Lee et al., "Field–assisted bonding below 200° C. using metal and glass thin–film interlayers", (accepted for publication Dec. 22, 1986), 3 pgs.

Masayoshi Esashi et al., "Low–temperature Silicon–to–silicon Anodic Bonding with Intermediate Low Melting Point Glass", Sensors and Actuators, A21–23 (1990) pp. 931–934.

H.J. Quenzer et al., "Silicon—Silicon Anodic–Bonding with Intermediate glass layers using spin–on glasses", IEEE The Ninth Annual International Workshop on Micro Electro Mechanical Systems, *An Investigation of Micro Structures, Sensors, Actuators, Machines and Systems* —Sponsored by the IEEE Robotics and Automation Society, San Diego, California, USA, Feb. 11–15, 1996, pp. 272–276.

I. W. Rangelow, "Reactive ion etching for high aspect ratio silicon micromachining", Surface and Coatings Technology 97 (1997) pp. 140–150.

Woo–Beom Choi et al., "Anodic bonding technique for silicon–to–ITO coated glass bonding", SPIE vol. 3046—0277–786X/97, pp. 336–341.

P–F Indermühle et al., "Patterned thick photoresist layers for protection of protruding structures during wet and dry etching processes", J. Micromech. Microeng. 8 (1998) pp.74–76.

J.D. Mun et al., "S25–2 Larage Area Electrostatic Bonding for Macropackaging of a Field Emission Display", Asia Display '95, pp. 621–624.

Babu R. Chalamala and Bruce E. Gnade, "Fed Up with Fat Tubes", IEEE Spectrum, Apr. 1998, pp. 42–51.

(List continued on next page.)

*Primary Examiner*—Michael H. Day
*Assistant Examiner*—Mack Haynes
(74) *Attorney, Agent, or Firm*—Dorsey & Whitney LLP

(57) ABSTRACT

A display includes a baseplate and an emitter formed on the baseplate. The display also includes a faceplate having a cathodoluminescent coating on a surface facing the baseplate and the emitter. A plurality of spacers separate the faceplate and the baseplate to prevent bowing of the faceplate or the baseplate towards each other. The spacers are formed from silicon, simplifying field emission device assembly and resulting in a superior display.

31 Claims, 7 Drawing Sheets

OTHER PUBLICATIONS

Author Unknown, "Silicon Mechanical Properties", "Silicon Electrical Properties (Si)", "Ionization Energies for Various Dopants", http://www.ai.mit.edu/people/tk/tks/silicon–mechanial.htm & http://www/ai.mit.edu/people/tk/tks/silicon–electrical.htm Oct. 11, 1998, 2 pgs.

Author Unknown, "Deep Si RIE Processing",MEMS Tech-Net–MEMS Technology Applications Center, http//mems.mcnc.org/technet/deeprie.html, Oct. 11, 1998, 6 pgs.

Author Unknown, "Capacitor with a Dielectric", Chapter 27, 27–6, p. 627.

* cited by examiner

CONDUCTIVE SPACER FOR FIELD EMISSION DISPLAYS AND METHOD

GOVERNMENT RIGHTS

This invention was made with government support under Contract No. DABT63-93-C-0025 awarded by Advanced Research Projects Agency (ARPA). The government has certain rights in this invention.

TECHNICAL FIELD

This invention relates in general to visual displays for electronic devices and in particular to improved spacers for field emission displays.

BACKGROUND OF THE INVENTION

FIG. 1 is a simplified side cross-sectional view of a portion of a field emission display 10 including a faceplate 18 and a baseplate 20 in accordance with the prior art. FIG. 1 is not drawn to scale. The faceplate 18 includes a transparent viewing screen 22, an antireflective layer 23, a transparent conductive layer 24 and a cathodoluminescent layer 26. The transparent viewing screen 22 supports the layers 23, 24 and 26, acts as a viewing surface and as a wall for a hermetically sealed package formed between the viewing screen 22 and the baseplate 20. The viewing screen 22 may be formed from glass. The antireflective layer 23 may be formed from $Si_3N_4$ having a thickness of 900 Angstroms. The transparent conductive layer 24 may be formed from indium tin oxide. The cathodoluminescent layer 26 may be segmented into localized portions that are separated from each other within openings in a grille 28 of light-absorbing, opaque material formed on the antireflective layer 23. The light absorption and opacity of the grille 28 increases the contrast of the faceplate 18. The grille 28 is formed by conventional patterning of a layer of material such as silicon, cobalt oxide, manganese oxide or chromium oxide.

In a conventional monochrome display 10, each localized portion of the cathodoluminescent layer 26 forms one pixel of the display 10. Also, in a conventional color display 10, each localized portion of the cathodoluminescent layer 26 forms a primary color such as a green, red or blue sub-pixel of the display 10. Materials useful as cathodoluminescent materials in the cathodoluminescent layer 26 include $Y_2O_3$:Eu (red, phosphor P-56), $Y_3(Al, Ga)_5O_{12}$:Tb (green, phosphor P-53) and $Y_2(SiO_5)$:Ce (blue, phosphor P-47) available from Osram Sylvania of Towanda Pa. or from Nichia of Japan.

The baseplate 20 includes emitters 30 formed on a planar surface of a substrate 32, which may be formed from glass having a layer of silicon formed on it. The baseplate 20 is coated with a dielectric layer 34. In one embodiment, this is effected by deposition of silicon dioxide via a conventional TEOS process. The dielectric layer 34 is formed to have a thickness that is approximately equal to or just less than a height of the emitters 30. This thickness is on the order of 0.4 microns, although greater or lesser thicknesses may be employed. A conductive extraction grid 38 is formed on the dielectric layer 34. The extraction grid 38 may be formed, for example, as a thin layer of polysilicon. The radius of an opening 40 created in the extraction grid 38, which is also approximately the separation of the extraction grid 38 from the tip of the emitter 30, is about 0.4 microns, although larger or smaller openings 40 may also be employed.

In operation, the extraction grid 38 is biased to a voltage on the order of 100 volts, although higher or lower voltages may be used, while the baseplate 32 is maintained at a voltage of about zero volts. Signals coupled to the emitter 30 allow electrons to flow to the emitter 30. Intense electrical fields between the emitter 30 and the extraction grid 38 cause field emission of electrons from the emitter 30 in response to the signals impressed on the emitter 30.

An anode voltage $V_A$, ranging up to as much as 5,000 volts or more but often 2,500 volts or less, is applied to the faceplate 18 via the transparent conductive layer 24. The electrons emitted from the emitter 30 are accelerated to the faceplate 18 by the anode voltage $V_A$ and strike the cathodoluminescent layer 26. The electron bombardment causes light emission in selected areas, i.e., those areas adjacent to where the emitters 30 are emitting, and forms luminous images such as text, pictures and the like.

A gap separating the faceplate 18 and the baseplate 20 of the conventional field emission display 10 is relatively small, on the order of one thousandth of an inch or twenty-five microns per 100 volts of anode voltage $V_A$. Too large a gap leads to spreading of the emitted electrons and thus to defocusing or blurring of luminous images formed on the faceplate 18. Too small a gap leads to catastrophic failure of the display 10 due to arcing between the faceplate 18 and the baseplate 20. The gap must be evacuated in order for electrons to travel from the emitters 30 to the faceplate 18. As a result, atmospheric pressure is exerted on the faceplate 18 and the baseplate 20 that forces the baseplate 20 and the faceplate 18 toward each other.

In relatively small displays 10, such as those having a diagonal measurement of an inch or less, the pressure on the faceplate 18 does not cause significant bowing of the faceplate 18. In larger displays 10, however, the faceplate 18 tends to bow towards the baseplate 20, and the baseplate 20 also bows towards the faceplate 18. In a display 10 having a diagonal measurement of thirty inches, the force compressing the baseplate 20 and the faceplate 18 together is several tons. The bowing is exaggerated because of need to keep the faceplate 18 and the baseplate 20 light and thus to make them as thin as is practicable. Bowing leads to non-uniform spacing between the faceplate 18 and the baseplate 20, causing focusing and intensity variations and thereby degrading images formed on the faceplate 18. As a result, spacers 62 are incorporated between the faceplate 18 and the baseplate 20.

The spacers 62 typically are formed from glass and have a width of 25 to 250 micrometers. The spacers 62 typically extend from the baseplate 20 to the faceplate 18 and thus have a height that is similar to the spacing separating the faceplate 18 from the baseplate 20, in the range of 0.2 to 1 mm. In relatively small displays 10, the transparent viewing screen 22 may be formed from glass having a thickness of about 1.1 mm. In such displays 10, spacers 62 are needed about every fifteen mm. in order to provide adequate support for the faceplate 18, but the spacers 62 may be separated by smaller distances. The spacers 62 typically are positioned to contact the faceplate 18 in areas that are opaque due to the grille 28 in order to avoid interfering with images formed on the display 10.

Spacers 62 tend to be made from insulating materials because the large voltage applied to the transparent conductive layer 24 otherwise causes arcing between the baseplate 20 and the faceplate 18. Additionally, other techniques that might be tried are either impractical or unworkable for a variety of reasons. For example, forming reverse-biased diodes (not illustrated) on the baseplate 32 and placing conductive spacers 32 on the reverse-biased diodes is impractical, because the materials requirements for such diodes are not compatible with other requirements for the baseplate 32.

Typically, the spacers 62 are made from glass or ceramic. As described in U.S. Pat. No. 5,717,287, entitled "Spacers For A Flat Panel Display And Method," issued to Amrine et al., the spacers 62 can cause problems in the display 10. When the spacers 62 are affixed to the faceplate 18 using organic glue, the glue can chemically decompose, causing contamination of the evacuated interior of the display 10. Alternatively, the glue can exhibit mechanical failure, causing the spacers 62 to become detached and misplaced in the interior of the display 10. Affixation of glass spacers 62 to the faceplate 18 using glass frit results in a brittle bond that is subject to mechanical failure and that may cause particulate contamination within the display 10. Additionally, use of a jig to facilitate correct placement of the spacers 62 on the faceplate 18 is laborious and may be unreliable.

What is needed is a way to simplify formation and accurate placement of spacers in field emission displays and to provide more robust spacers for use in field emission displays.

SUMMARY OF THE INVENTION

In accordance with one aspect of the invention, a field emission display includes a spacer formed from silicon that prevents significant faceplate or baseplate bowing. In one aspect, the spacer is formed in situ on the faceplate after deposition of other faceplate components by anodic bonding of a silicon wafer to a glass layer that has been formed on the faceplate. Portions of the silicon wafer that are not needed for the spacer are removed by directional etching processes. In one aspect, the spacer also forms a diode that is reverse biased by voltages applied to the faceplate to accelerate electrons towards the faceplate.

DETAILED DESCRIPTION OF THE INVENTION

Figure 1:
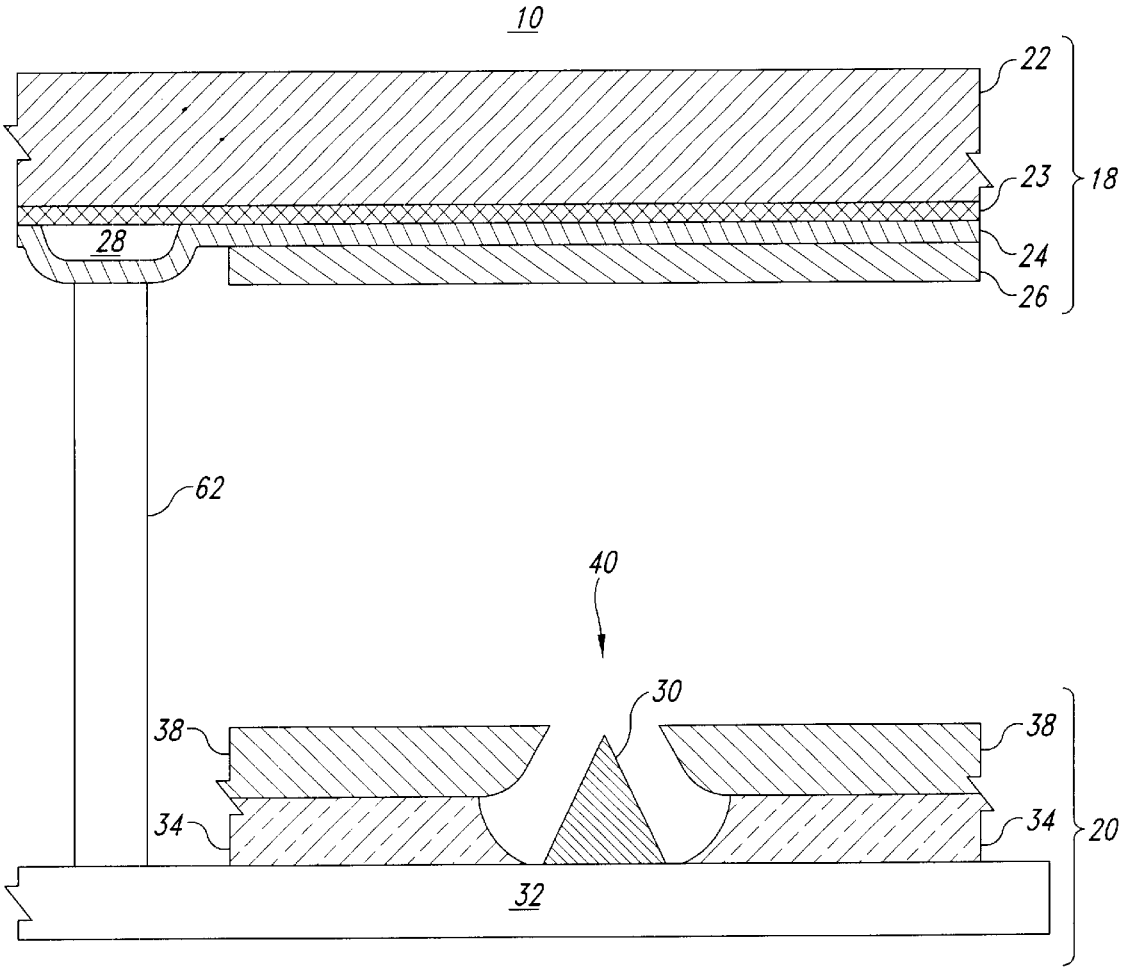
Fig. 1 (PRIOR ART)
FIG. 1 is a simplified side cross-sectional view of a portion of a field emission display including a spacer, according to the prior art.
Figure 2:
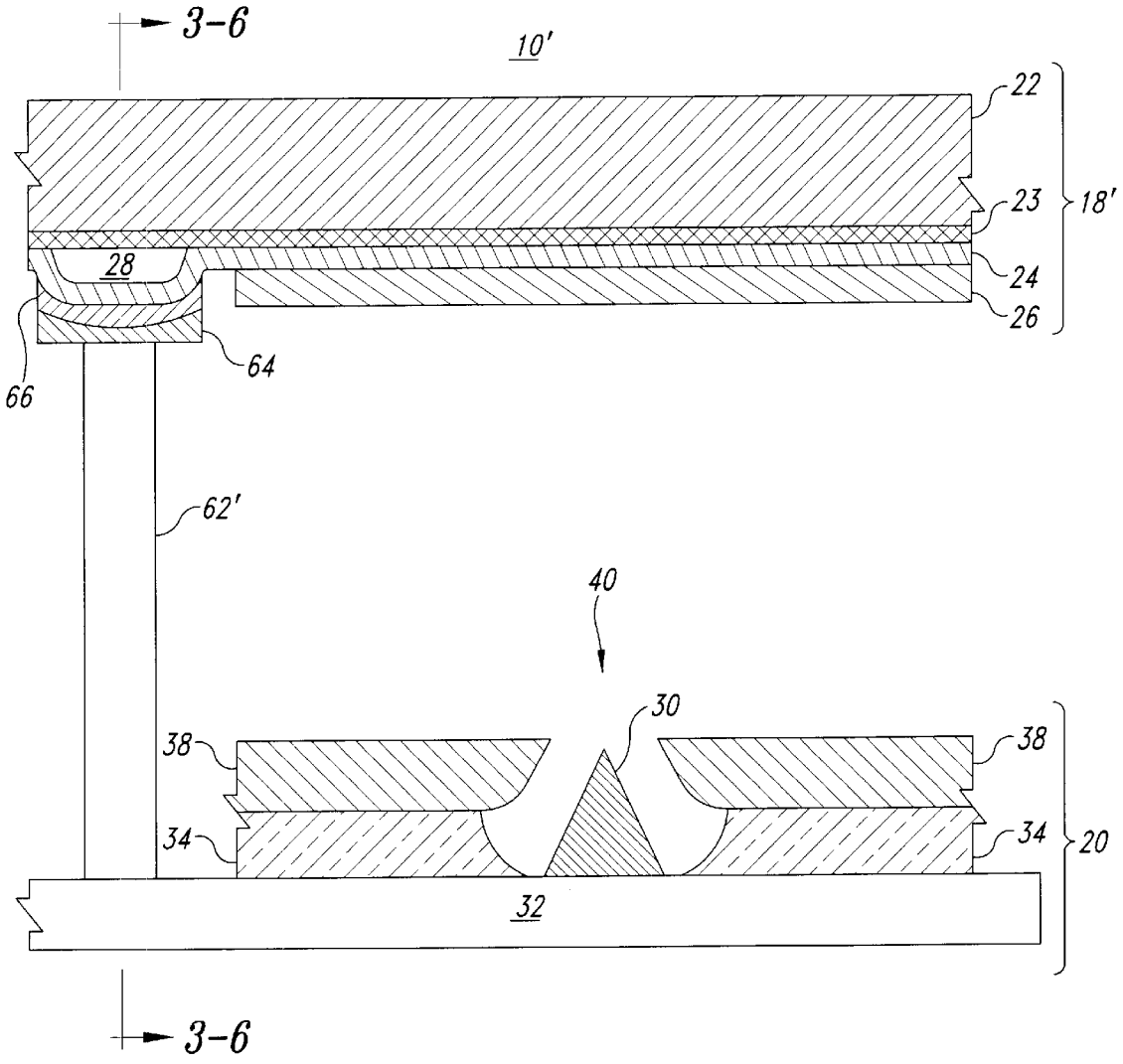
FIG. 2 is a simplified side cross-sectional view of a portion of a field emission display including a spacer, according to an embodiment of the present invention.

FIG. 2 is a simplified side cross-sectional view of a portion of a field emission display 10' including a spacer 62', in accordance with an embodiment of the present invention. FIG. 2 is not drawn to scale. Many of the components used in the field emission display 10' shown in FIG. 2 are identical to components used in the field emission display 10 of FIG. 1. Therefore, in the interest of brevity, these components have been provided with the same reference numerals, and an explanation of them will not be repeated.

In the embodiment of FIG. 2, the spacer 62' may be formed from silicon. In one embodiment, an insulating layer 64 positioned at the end of the spacer 62' is formed from spin-on glass. In one embodiment, the insulating layer 64 has a thickness in excess of two microns. A layer 66 may be included between the insulating layer 64 and the transparent conductive layer 24. In one embodiment, the layer 66 is formed from conventional polycrystalline silicon. In another embodiment, a conventional layer of metal, such as aluminum, nickel or other metal, forms the layer 66. The layer 66 is used to protect the transparent conductive layer 24 from chemical attack at a later stage in fabrication when the insulating layer 64 is etched. In one embodiment, the spacer 62 may be conductive and attached to the insulating layer 64 through a process of anodic bonding, as described below.

Figure 3:
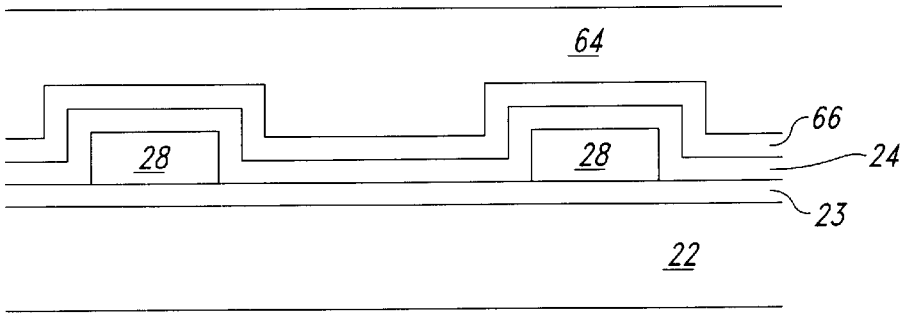
FIG. 3 is a simplified side cross-sectional view of a portion of a faceplate at one stage in fabrication, according to an embodiment of the present invention.

FIG. 3 is a simplified side cross-sectional view of a portion of a faceplate at one stage in fabrication, according to an embodiment of the present invention. The grille 28 has previously been fabricated on the transparent viewing screen 22 using conventional photolithography and deposition techniques. The transparent conductive layer 24 has previously been fabricated on the transparent viewing screen 22 and the grille 28 using conventional deposition techniques.

The layer 66 has previously been fabricated of polycrystalline silicon or metal using conventional deposition techniques. The insulating layer 64 may be formed using spin-on-glass (e.g., TEOS and a sodium or potassium salt dissolved in ethanol), as described in "Silicon-Silicon Anodic-Bonding With Intermediate Glass Layers Using Spin-On Glasses," by H. J. Quenzer et al. (Proc. Ninth Annual Int. Workshop on Micro Electro Mech. Sys., IEEE Cat. No. 96CH35856 (Feb. 11–15, 1996), pp. 272–267.). Alternatively, the insulating layer 64 may be formed by sputtering, as described in "Field-Assisted Bonding Below 200° C. Using Metal And Glass Thin-Film Interlayers," by W. Y. Lee et al. (App. Phys. Lett., Vol. 59, No. 9 (1987), pp. 522–524.). In another embodiment, the insulating layer 64 may be formed using other conventional processes, such as electron beam evaporation. In one embodiment, the insulating layer 64 may be planarized and smoothed using conventional chemical-mechanical polishing.

Figure 4:
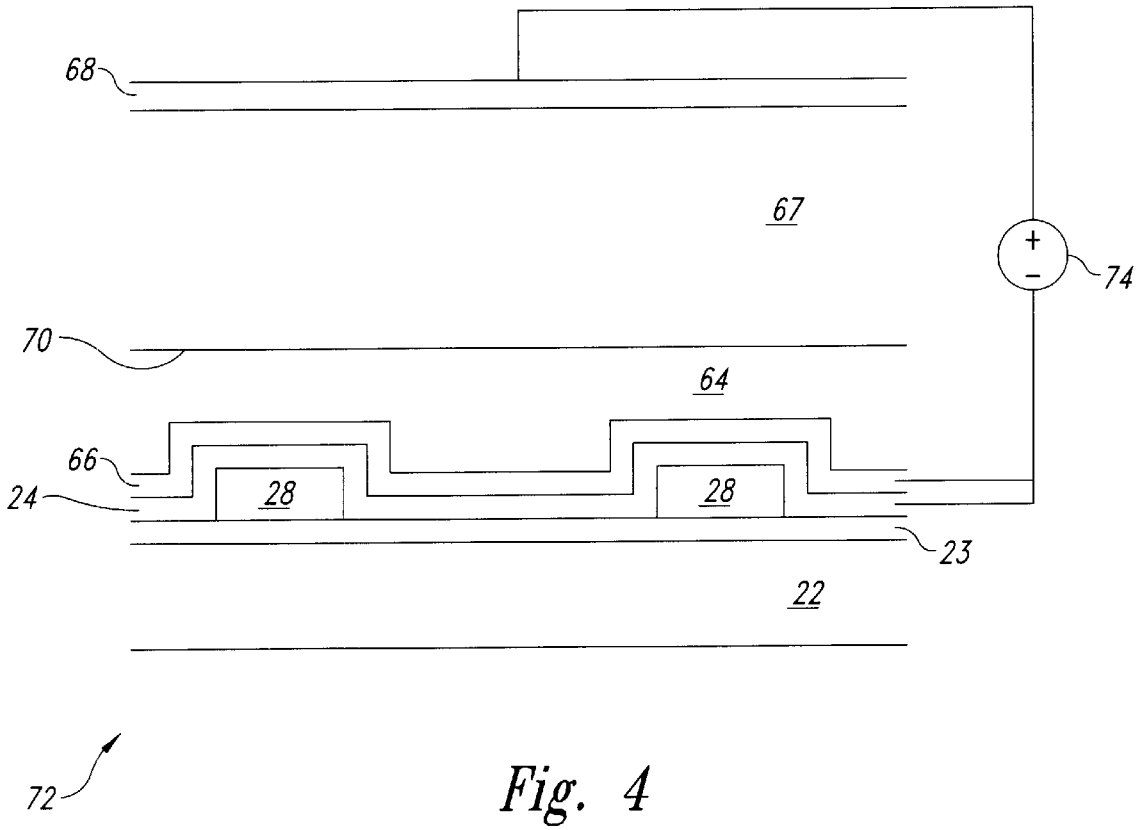
FIG. 4 is a simplified side cross-sectional view of the faceplate of FIG. 3 at a later stage in fabrication, according to an embodiment of the present invention.

FIG. 4 is a simplified side cross-sectional view of the faceplate of FIG. 3 at a later stage in fabrication, according to an embodiment of the present invention. A silicon wafer 67 having one metallized surface 68 is placed to have another surface 70 in intimate contact with the insulating layer 64 to form a composite assembly 72. A voltage source 74 has a negative lead coupled to the transparent conductive layer 24 and to the layer 66. A positive lead of the voltage source 74 is coupled to the metallized surface 68. In one embodiment, the metallized surface 68 forms an ohmic contact with the silicon wafer 67. In another embodiment, the metallized surface forms a Schottky contact with n-type silicon forming the silicon wafer 67. The composite assembly 72 is heated and a voltage of several hundred volts is supplied by the voltage source 74 to anodically bond the silicon wafer 67 to the insulating layer 64.

Anodic bonding is described in U.S. Pat. No. 3,397,278, entitled "Anodic Bonding," issued to D. I. Pomerantz, and in "Field Assisted Glass-Metal Sealing," by G. Wallis et al. (Jour. App. Phys., Vol. 40, No. 10 (September 1969), pp. 3946–3949.). Anodic bonding of silicon to an insulating layer is described in "Anodic Bonding Technique For Silicon-to-ITO Coated Glass Bonding," by W.-B. Choi et al. (Proc. Soc. Phot. Opt. Inst. Eng., Vol. 3046 (1997), pp. 336–341.). Selection of glass composition for the insulating layer 64 to provide temperature coefficient of expansion matching to the silicon wafer 67 and to allow room-temperature anodic bonding is discussed in "Low-Temperature Silicon-to-Silicon Anodic Bonding With Intermediate Low Melting Point Glass," by M. Esashi et al. (Sensors and Actuators, A21–A23 (1990), pp. 931–934.). Significantly, anodic bonding provides bonds having superior mechanical strength and does not introduce additional materials that can result in contamination of the interior of the field emission display 10'.

Figure 5:
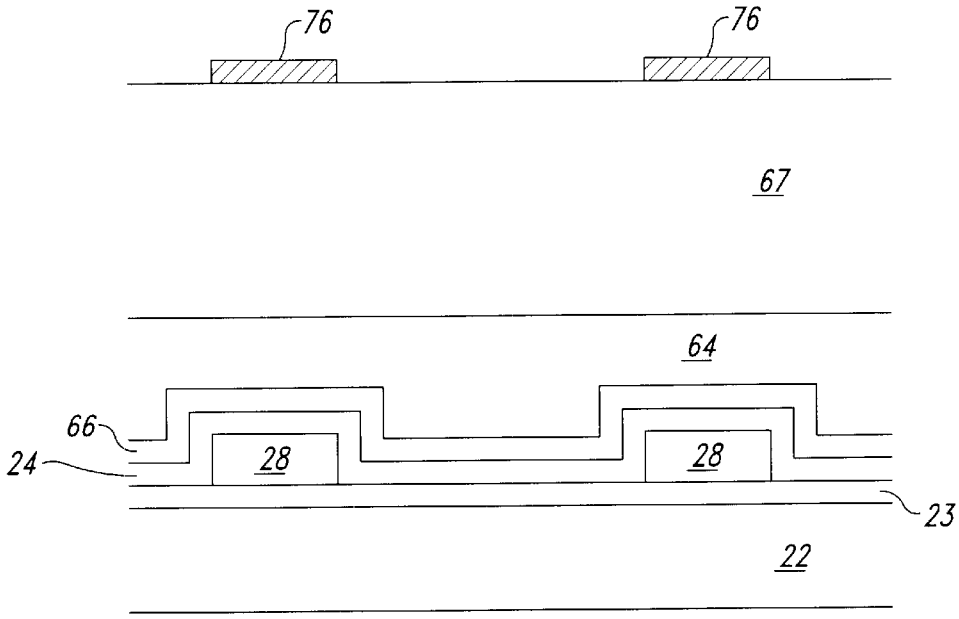
FIG. 5 is a simplified side cross-sectional view of the faceplate of FIG. 4 at a later stage in fabrication, according to an embodiment of the present invention.

FIG. 5 is a simplified side cross-sectional view of the faceplate of FIG. 4 at a later stage in fabrication, according to an embodiment of the present invention. The metallization on the surface 68 (FIG. 4) has been stripped using conventional etching techniques and a hard mask 76 is formed from a material such as $SiO_2$ deposited by conventional TEOS or $Si_3N_4$ deposited by conventional PECVD. The hard mask 76 is patterned using conventional photolithographic techniques.

Figure 6:
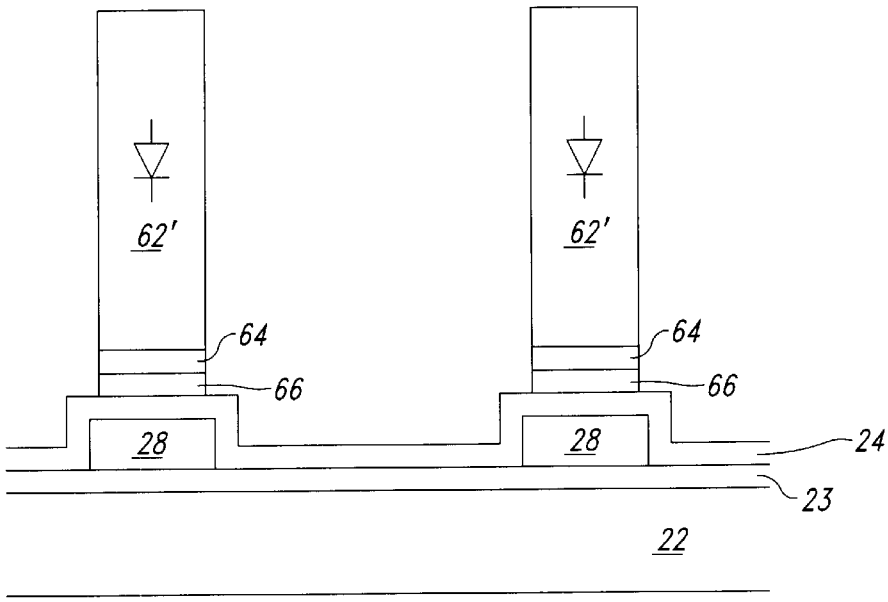
FIG. 6 is a simplified side cross-sectional view of the faceplate of FIG. 5, according to an embodiment of the present invention.

FIG. 6 is a simplified side cross-sectional view of the faceplate of FIG. 5 at a later stage in fabrication, according to an embodiment of the present invention. Reactive ion etching is used to anisotropically etch the silicon wafer 67 (FIGS. 4 and 5), leaving the spacers 62'. Anisotropic etching is discussed in "Reactive Ion Etching For High Aspect Ratio Silicon Micromachining," by I. W. Rangelow (Surf. and Coatings Tech. 97 (1997), pp. 140–150.). Reactive ion etchers capable of etching >300 microns of silicon at an etch rate of 3 microns a minute using positive photoresist or a hard mask are available from Surface Technology Systems USA, Inc., 611 Veterans Boulevard, Suite 107, Redwood City, Calif. 94063.

In one embodiment, the spacers 62' are formed from silicon having a dopant concentration of about $2\times10^{14}/cm^3$ or less to realize an avalanche breakdown voltage of in excess of 1,000 volts, and in any case a dopant concentration of $7\times10^4/cm^3$ or less to realize an avalanche breakdown voltage of in excess of 400 volts. In one embodiment, a cathode of the spacer 62' is coupled to the faceplate 18'. In one embodiment, the cathode is formed as a Schottky contact with the faceplate 18'. In one embodiment, an anode is formed by doping the portion of the spacer 62' that will contact the baseplate 20 with acceptors. In one embodiment, the spacer 62' is formed from intrinsic silicon in order to realize a high resistivity. Gold doping may be used to reduce mobile charge carrier concentrations in the spacer 62'. In one embodiment, the spacer 62' is formed from polycrystalline silicon. In one embodiment, the spacer 62' is formed as a diode having a carrier concentration such that a depletion region in the diode extends along most of the length of the spacer from the faceplate 18' to the baseplate 20 when the anode voltage $V_A$ is applied to the faceplate 18'.

It will be appreciated that spacers 62' that include diodes may be formed in a variety of different ways, and may have a p-n junction that may be placed anywhere along the height of the spacer 62' by suitable choice of doping levels and other conventional diode parameters. It will also be appreciated that a Schottky junction may be formed at either end of the spacer 62' by appropriate choice of conductivity type for the spacer 62'. In one embodiment, the spacer 62' is coated with a conventional passivation layer (not shown). In one embodiment, respective ends of the spacer 62' are coupled to conventional conductors (not shown) formed on the faceplate 18' and on the baseplate 20. In one embodiment, ends of the spacers 62' corresponding to the anodes shown in FIG. 6 couple to bumps of soft conductive material (not shown) formed on the baseplate 20.

Figure 7:
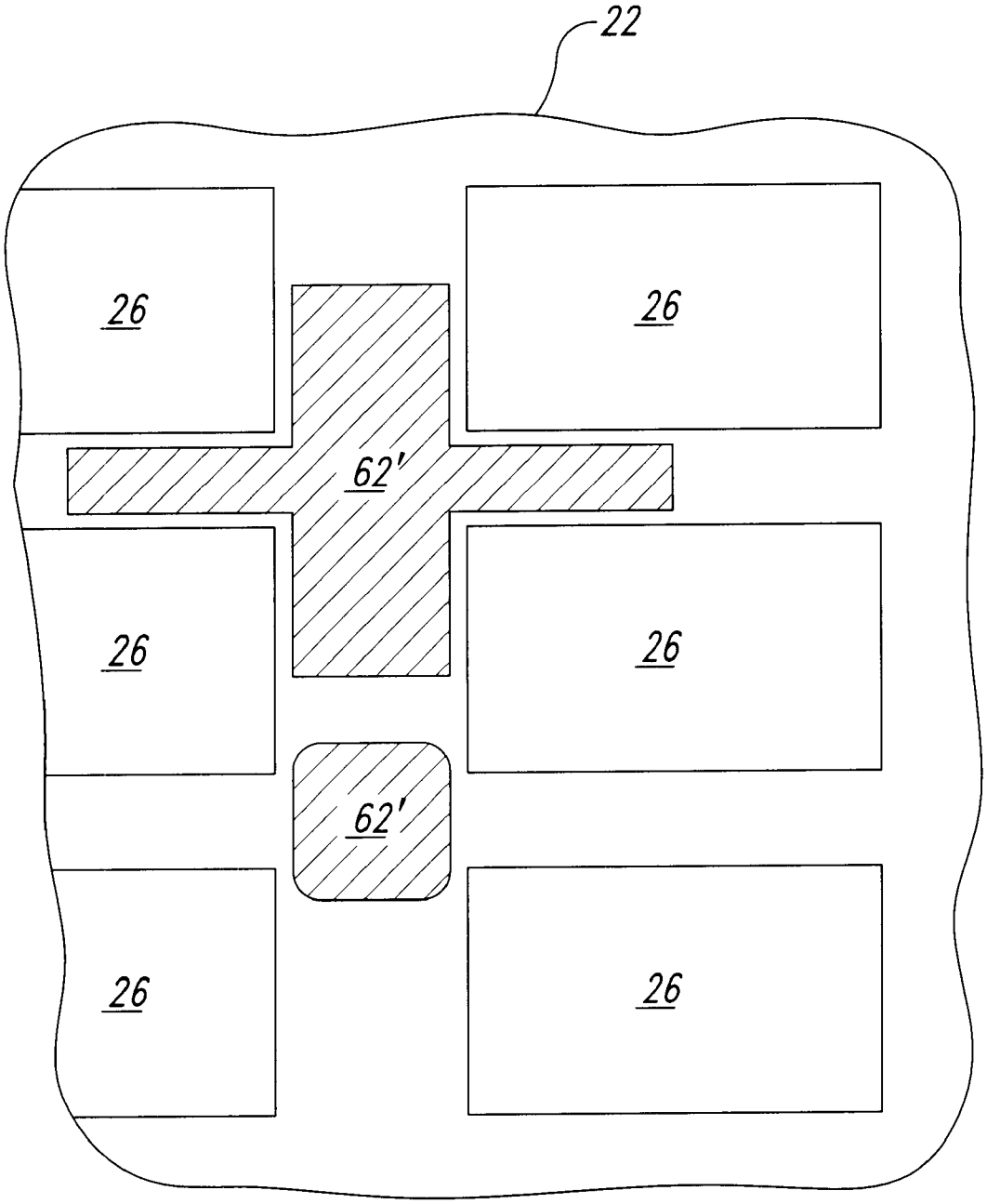
FIG. 7 is a simplified plan view of a portion of the faceplate of FIG. 6 including spacers of arbitrary geometry, according to an embodiment of the present invention.

FIG. 7 is a simplified plan view of a portion of the faceplate of FIG. 6 including spacers 62' of arbitrary geometry, according to an embodiment of the present invention. In one embodiment, a faceplate for a display 10' having XGA resolution includes an array of approximately 1024 by 768 pixels formed from cathodoluminescent layers 26. In this type of display 10', each pixel is about 60 microns by 180 microns, providing a faceplate having a display area of 9.65 inches by 7.28 inches. The cathodoluminescent layer 26 may be formed using a resist formed from polyvinyl alcohol and an ammonium dichromate sensitizer. The resist may be deposited and patterned after the spacers 62' are formed. The insulating layer 64 may then be etched, for example with a buffered oxide etch containing hydrofluoric acid. The layer 66 may be etched using conventional etching processes. Isopropyl alcohol may be used as a carrier medium to selectively deposit the cathodoluminescent layer 26, using the transparent conductive layer 24 as one electrode in a conventional electrophoretic deposition process. Fabrication of the field emission display 10' is subsequently completed via conventional fabrication steps.

Figure 8:
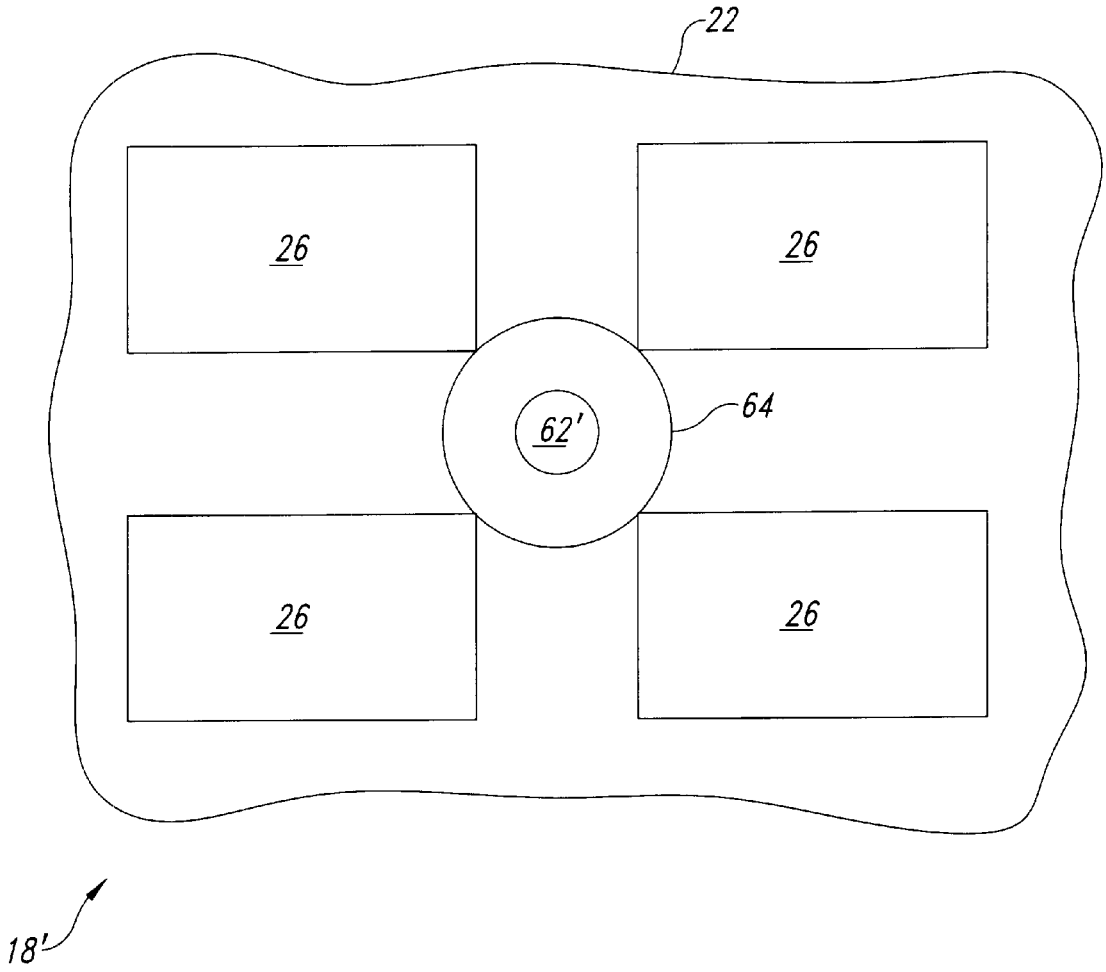
FIG. 8 is a simplified plan view of a portion of a faceplate including spacers and an insulating layer surrounding an area where the spacer contacts the faceplate, in accordance with an embodiment of the present invention.

FIG. 8 is a simplified plan view of a portion of a faceplate 18' including spacers 62' and an insulating layer 64 surrounding an area where the spacer 62' contacts the faceplate 18', in accordance with an embodiment of the present invention. The insulating layer 64 is formed to have a thickness sufficient to withstand the anode voltage $V_A$, and is patterned to provide an area surrounding the spacer 62' that is wide enough to prevent arcing from the spacer 62' to the transparent conductive layer 24, i.e., having a width comparable to the height of the spacer 62'. For example, for a glass having a breakdown field strength of $1.4\times10^5$ volts/cm. to withstand an anode voltage $V_A$ of 500 volts, an insulating layer 64 having a thickness of about forty required.

In one embodiment, the pixels 26 are formed of cathodoluminescent materials chosen to emit different colors of light when bombarded by electrons. For example, the lower left and upper right pixels 26 may include phosphor P-56 and emit red light. The upper left pixel 26 may include phosphor P-53 and emit green light, and the lower right pixel 26 may include phosphor P-47 and emit blue light.

Figure 9:
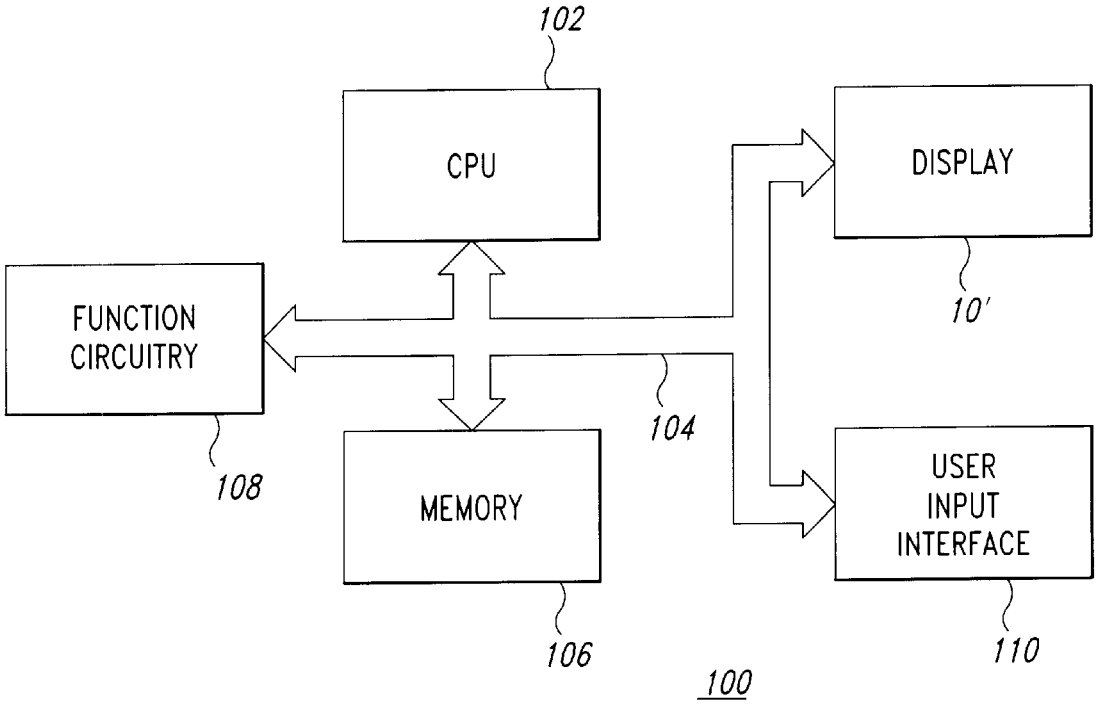
FIG. 9 is a simplified block diagram of a computer including a field emission display using the focusing electrode, according to an embodiment of the present invention.

FIG. 9 is a simplified block diagram of a portion of a computer 100 including the field emission display 10' having the spacer 62' as described with reference to FIGS. 2 through 8 and associated text. The computer 100 includes a central processing unit 102 coupled via a bus 104 to a memory 106, function circuitry 108, a user input interface 110 and the field emission display 10' including the spacer 62', according to the embodiments of the present invention. The memory 106 may or may not include a memory management module (not illustrated) and does include ROM for storing instructions providing an operating system and a read-write memory for temporary storage of data. The processor 102 operates on data from the memory 106 in response to input data from the user input interface 110 and displays results on the field emission display 10'. The processor 102 also stores data in the read-write portion of the memory 106. Examples of systems where the computer 100 or the display 10' finds application include personal/portable computers, camcorders, televisions, automobile electronic systems, microwave ovens and other home and industrial appliances.

Field emission displays 10' for such applications provide significant advantages over other types of displays, including reduced power consumption, improved range of viewing angles, better performance over a wider range of ambient lighting conditions and temperatures and higher speed with which the display can respond. Field emission displays find application in most devices where, for example, liquid crystal displays find application.

Although the present invention has been described with reference to various embodiments, the invention is not limited to these embodiments. Rather, the invention is limited only by the appended claims, which include within their scope all equivalent devices or methods which operate according to the principles of the invention as described.

What is claimed is:

1. A field emission display, comprising:

a baseplate;

a faceplate; and a plurality of spaced-apart spacers formed from conductive material and extending from the faceplate to the baseplate, wherein each of the spacers comprises a diode.

2. The display of claim 1 wherein the baseplate comprises:

a substrate;

an emitter formed on the substrate;

a dielectric layer formed on the substrate and having an opening formed about the emitter; and a conductive extraction grid formed on the dielectric layer and having an opening formed about the emitter.

3. The display of claim 1 wherein the baseplate comprises glass.

4. The display of claim 1 wherein the faceplate comprises:

a transparent insulating viewing screen;

a transparent conductive layer formed on the transparent viewing screen; and a cathodoluminescent layer formed on the transparent conductive layer, the faceplate positioned with the cathodoluminescent layer towards the baseplate.

5. The display of claim 1 wherein each of the spacers includes silicon.

6. The display of claim 1 wherein each of the spacers comprises a silicon diode having a cathode coupled to the faceplate and an anode coupled to the baseplate.

7. The display of claim 1 wherein each of the spacers comprises a silicon diode having a cathode anodically bonded to the faceplate and an anode coupled to the baseplate.

8. The display of claim 1 wherein the faceplate comprises:

a transparent viewing screen;

a transparent conductive layer formed on the transparent viewing screen;

an insulating layer formed on first portions of the transparent conductive layer;

cathodoluminescent regions formed on second portions of the transparent conductive layer; and wherein each of the spacers is anodically bonded to first portions of the insulating layer surrounded by second portions of the insulating layer extending across enough of the transparent conductive layer to prevent arcing between the transparent conductive layer and the spacers.

9. A field emission display comprising:

a baseplate comprising:

a substrate;

an emitter formed on the substrate;

a dielectric layer formed on the substrate and having an opening formed about the emitter; and a conductive extraction grid formed on the dielectric layer and having an opening formed about the emitter;

a faceplate comprising:

a transparent insulating viewing screen;

a transparent conductive layer formed on the transparent viewing screen;

a cathodoluminescent layer formed on first portions of the transparent conductive layer, the faceplate positioned with the cathodoluminescent layer towards the substrate; and a plurality of insulating layers formed on respective spaced-apart second portions of the transparent conductive layer; and a plurality of spacers formed from conductive material, the spacers extending from the respective insulating layers formed on the second portions of the conductive layer to the baseplate.

10. The display of claim 9 wherein each of the spacers comprises a diode.

11. The display of claim 9 wherein each of the spacers comprises a silicon diode having a cathode coupled to the faceplate and an anode coupled to the baseplate.

12. The display of claim 9 wherein the cathodoluminescent layer comprises:

a first subset of cathodoluminescent regions providing a first primary color of light when bombarded by electrons;

a second subset of cathodoluminescent regions providing a second primary color of light when bombarded by electrons; and a third subset of cathodoluminescent regions providing a third primary color of light when bombarded by electrons.

13. The display of claim 9 wherein the insulating layer comprises a layer of glass having a thickness in excess of two microns.

14. The display of claim 9 wherein each of the spacers comprises silicon and is anodically bonded to the insulating layer.

15. A computer, comprising:

a central processing unit;

a memory device coupled to the central processing unit, the memory device storing instructions and data for use by the central processing unit;

an input interface; and a display comprising:

a baseplate;

a faceplate, wherein the faceplate comprises:

a transparent insulating viewing surface;

a transparent conductor formed on the transparent viewing surface;

a cathodoluminescent layer formed on first portions of the conductive transparent layer;

an insulating layer formed on second portions of the conductive transparent layer, the insulating layer comprising glass, wherein the conductive spacer is anodically bonded to the insulating layer opposite the transparent conductive layer; and a spacer formed from a conductive material and extending from the faceplate to the baseplate.

16. The computer of claim 15 wherein the baseplate comprises:

a substrate;

an emitter formed on a surface of the substrate;

a dielectric layer formed on the substrate, the dielectric layer having an opening surrounding the emitter; and a conductive extraction grid formed on the dielectric layer, the extraction grid having an opening surrounding a tip of the emitter.

17. The computer of claim 15 wherein the spacer comprises a diode having a cathode coupled to the faceplate and an anode coupled to the baseplate.

18. The computer of claim 15 wherein the spacer comprises silicon and is anodically bonded to the faceplate.

19. The computer of claim 15 wherein the spacer comprises a plurality of spacers that are spaced apart from each other.

20. A field emission display, comprising:

a baseplate;

a faceplate, wherein the faceplate comprises:

a transparent viewing screen;

a transparent conductive layer formed on the transparent viewing screen;

an insulating layer formed on first portions of the transparent conductive layer;

cathodoluminescent regions formed on second portions of the transparent conductive layer; and a plurality of spaced-apart spacers formed from conductive material and extending from the faceplate to the baseplate, wherein each of the spacers is anodically bonded to first portions of the insulating layer surrounded by second portions of the insulating layer extending across enough of the transparent conductive layer to prevent arcing between the transparent conductive layer and the spacers.

21. The display of claim 20 wherein the baseplate comprises:

a substrate;

an emitter formed on the substrate;

a dielectric layer formed on the substrate and having an opening formed about the emitter; and a conductive extraction grid formed on the dielectric layer and having an opening formed about the emitter.

22. The display of claim 20 wherein the baseplate comprises glass.

23. The display of claim 20 wherein each of the spacers includes silicon.

24. The display of claim 20 wherein each of the spacers comprises a diode.

25. The display of claim 20 wherein each of the spacers comprises a silicon diode having a cathode coupled to the faceplate and an anode coupled to the baseplate.

26. The display of claim 20 wherein each of the spacers comprises a silicon diode having a cathode anodically bonded to the faceplate and an anode coupled to the baseplate.

27. A computer, comprising:

a central processing unit;

a memory device coupled to the central processing unit, the memory device storing instructions and data for use by the central processing unit;

an input interface; and a display comprising:

a baseplate;

a faceplate; and a spacer formed from a conductive material and extending from the faceplate to the baseplate, wherein the spacer comprises a diode having a cathode coupled to the faceplate and an anode coupled to the baseplate.

28. The computer of claim 27 wherein the baseplate comprises:

a substrate;

an emitter formed on a surface of the substrate;

a dielectric layer formed on the substrate, the dielectric layer having an opening surrounding the emitter; and a conductive extraction grid formed on the dielectric layer, the extraction grid having an opening surrounding a tip of the emitter.

29. The computer of claim 27 wherein the faceplate comprises:

a transparent insulating viewing surface;

a transparent conductor formed on the transparent viewing surface;

a cathodoluminescent layer formed on first portions of the conductive transparent layer; and an insulating layer formed on second portions of the conductive transparent layer, the insulating layer comprising glass, wherein the conductive spacer is anodically bonded to the insulating layer opposite the transparent conductive layer.

30. The computer of claim 27 wherein the spacer comprises silicon and is anodically bonded to the faceplate.

31. The computer of claim 27 wherein the spacer comprises a plurality of spacers that are spaced apart from each other.

* * * * *

UNITED STATES PATENT AND TRADEMARK OFFICE

CERTIFICATE OF CORRECTION

PATENT NO. : 6,525,462 B1
DATED : February 25, 2003
INVENTOR(S) : Won-Joo Kim

It is certified that error appears in the above-identified patent and that said Letters Patent is hereby corrected as shown below:

Title page,
Item [56], References Cited, OTHER PUBLICATIONS, "W.Y. Lee et al.," reference, "interlayers", (accepted for" should read -- interlayers" (accepted for --; "Woo-Boem Choi et al.," reference , "SPIE vol. 3046—" should read -- SPIE vol. 3046- --; "P-F Indermühle et al." reference, "pp.74-76." should read -- pp. 74-76. --; "J.D. Mun et al.," reference "S25-2 Larage Area" should read -- S25-2 Large Area --; "Author Unknown," reference, "Processing",MEMS" should read -- Processing," MEMS --; and reference, "http//" should read -- http:// --
Item [57], ABSTRACT,
Line 6, "or the baseplate towards" should read -- or the baseplate toward --

Column 1,
Line 21, "an antireflective layer" should read -- an anti-reflective layer --
Line 24, "24 and 26, acts as a viewing" should read -- 24 and 26, and acts as a viewing --
Line 26, "The antireflective layer" should read -- The anti-reflective layer --
Line 33, "formed on the antireflec-" should read -- formed on the anti-reflec- --

Column 2,
Line 38, "because of need to" should read -- because of the need to --

Column 3,
Line 6, "For A Flat Panel Display And Method,"" should read -- For a Flat Panel Display and Method," --

Column 4,
Line 42, "Anodic-Bonding With" should read -- Anodic-Bonding with --
Line 45, "pp. 272-267.)." should read -- pp. 272-267). --
Line 48, "Metal And Glass" should read -- Metal and Glass --
Line 50, "522-524.). In another" should read -- 522-524). In another --

Column 5,
Line 8, "3946-3949.). Anodic" should read -- 3946-3949). Anodic --
Line 9, "Technique For" should read -- Technique for --
Line 12, "336-341.). Selection" should read -- 336-341). Selection --
Line 16, "Anodic Bonding With" should read -- Anodic Bonding with --
Line 18, "pp. 931-934.)." should read -- pp. 931-934). --
Line 38, "Ion Etching For High" should read -- Ion Etching for High --
Line 40, "pp. 140-150.). Reactive" should read -- pp. 140-150). Reactive --
Line 50, "of $7x10^4/cm^3$ or less" should read -- of $7x10^{14}/cm^3$ or less --

UNITED STATES PATENT AND TRADEMARK OFFICE

CERTIFICATE OF CORRECTION

PATENT NO. : 6,525,462 B1
DATED : February 25, 2003
INVENTOR(S) : Won-Joo Kim

It is certified that error appears in the above-identified patent and that said Letters Patent is hereby corrected as shown below:

Column 8,
Line 22, "layer towards" should read -- layer toward --

Column 8, line 67 through Column 9, line 7,
"of the conductive transparent layer; an insulating layer formed on second portions of the conductive transparent layer, the insulating layer comprising glass, wherein the conductive spacer is anodically bonded to the insulating layer opposite the transparent conductive layer;

and a spacer formed from a conductive material and extending from the faceplate to the baseplate." should read -- of the conductive transparent layer; a spacer formed from a conductive material and extending from the faceplate to the baseplate; and an insulating layer formed on second portions of the conductive transparent layer, the insulating layer comprising glass, wherein the conductive spacer is anodically bonded to the insulating layer opposite the transparent conductive layer. --

Signed and Sealed this

Twenty-third Day of March, 2004

JON W. DUDAS
*Acting Director of the United States Patent and Trademark Office*